US006616008B2

(12) United States Patent
Lemajeur

(10) Patent No.: US 6,616,008 B2
(45) Date of Patent: Sep. 9, 2003

(54) REFUSE CONTAINER LID AND HINGE ASSEMBLY

(76) Inventor: Scott W. Lemajeur, 1330 Westley La., West Dundee, IL (US) 60118

( * ) Notice: Subject to any disclaimer, the term of this patent is extended or adjusted under 35 U.S.C. 154(b) by 0 days.

(21) Appl. No.: 10/059,767

(22) Filed: Jan. 29, 2002

(65) Prior Publication Data

US 2003/0141312 A1 Jul. 31, 2003

(51) Int. Cl.[7] ..... B65D 51/04; B65F 1/00

(52) U.S. Cl. ..... 220/826; 220/908; 220/831; 220/844

(58) Field of Search ..... 220/831, 844, 220/826, 908, 832, 848, 673, 675; D34/7, 8, 9, 10, 11

(56) References Cited

U.S. PATENT DOCUMENTS 4,342,402 A * 8/1982 Jungles ..... 220/848

4,445,623 A * 5/1984 Kolling et al. ..... 220/844

* cited by examiner

*Primary Examiner*—Stephen K. Cronin
*Assistant Examiner*—James Smalley
(74) *Attorney, Agent, or Firm*—Charles F. Meroni, Jr.

(57) ABSTRACT

The present invention discloses a refuse container lid and hinge assembly, which comprises two angled members, two lid members, and two hinge rods. The angled members are attached to a refuse container and further comprise an attachment portion, a stop portion, and a plurality of knuckles. The lid members each comprise a crumple region and a support region. The crumple regions and support regions cooperatively allow the lid members to withstand planar and nonplanar compressive forces. The support regions each further comprise a plurality of U-shaped support ribs, which effect a patterned series of sloped superior surfaces and a patterned series of sloped inferior surfaces. The hinge rods hingedly connect the lids to the angled members. The ranges of pivotal motion are limited between a closed position and an open position wherein stop structures of the lid members contact the angled members thus restricting the lid members from pivoting more than a preferred number of degrees.

37 Claims, 5 Drawing Sheets

REFUSE CONTAINER LID AND HINGE ASSEMBLY

BACKGROUND OF THE INVENTION

1. Field of the Invention

The present invention relates to an improved refuse container lid and hinge assembly for use in conjunction with commercial refuse containers. More particularly, the present invention relates to a refuse container lid and hinge assembly, which container lid comprises improved rib support structure and which hinge assembly is adapted to provide improved, simplified mechanical stop structure.

2. Description of the Prior Art

The waste management industry has come under intense scrutiny in contemporary society in response to ever-growing concerns about environmental issues, particularly the importance of building toward a sustainable future. Accordingly, peripheral industries reliant on waste management must continually seek to improve methods and means for managing waste in response to greater societal demands for responsible and efficient waste management practices. One of the most efficient means for the transfer of waste materials is with the use of front-loading, overhead-emptying waste disposal vehicles. These so-called front-loading, overhead-emptying waste disposal vehicles are capable of lifting large capacity refuse containers from the front of the vehicle to an overturned position above the vehicle for emptying the contents of the refuse containers into integral, large capacity, trash compacting transfer compartments. As noted in U.S. Pat. No. 4,558,799, the utilization of front-loading, overhead emptying waste disposal vehicles significantly reduces the capital expenditure requirements to service a given population. For example, the use of front-loading, overhead emptying waste disposal vehicles cuts down on the number of manual labor positions required to service the containers, thus reducing capital expenditures.

It will thus be seen that the refuse containers employed in these scenarios comprise means to enable front-loading, overhead emptying waste disposal vehicles to lift the refuse containers overhead from an upright refuse containing position to an overturned, refuse emptying position, thus allowing refuse to fall under gravitational force into the trash compacting transfer compartments. The refuse containers employed in these scenarios often further comprise pivotable lids, which freely pivot about a hinge point under gravitational force as well as from reactive contact with accelerating refuse when the refuse containers are transitioned from an upright to an overturned position.

Not surprisingly, the waste transfer process in these scenarios requires heavy equipment since massive amounts of refuse material are thus transferred from disposal sites to treatment sites, the heavy equipment often comprising heavy metal refuse containers and transfer compartments. Furthermore, as noted in U.S. Pat. No. 5,975,345, there is constant concern that refuse container lids will pivot beyond a desired stop point and be damaged or destroyed from contact with the waste disposal vehicle or with compacted refuse within the transfer compartments. Lid systems have thus become an area of special interest to a number of peripheral industries reliant on waste management. Accordingly, refuse container lids and lid systems for enabling more responsible and efficient waste management practices have been developed and are known in the prior art. Known refuse container lids and lid systems, however, suffer from a number of deficiencies, several of which are described hereinafter.

U.S. Pat. No. 4,771,940 ('940 Patent), which issued to Taylor, discloses a Refuse Container Cover. The Taylor Refuse Container Cover discloses a double-walled substantially planar container lid wherein the first wall comprises a plurality of longitudinally-aligned support ribs and wherein the second wall comprises a plurality of laterally-aligned support ribs. Support brace receiving bosses are further provided to secure the cover in a fixed open position for refuse loading. Further, the upper surface of the first wall is arcuately configured both longitudinally and laterally and the underside of the second wall is arcuately configured longitudinally to provide additional stiffness and durability into the Refuse Container Cover. The '940 Patent further discloses an integral hinge means for securing the Refuse Container Cover to the refuse container. The '940 Patent does not disclose a container lid having integral, laterally-aligned support rib elements and longitudinally-aligned support rib elements in a single walled container lid. Further, the '940 Patent does not disclose a container lid in combination with a side-mounted hinge assembly for preventing the container lid from pivoting beyond a predetermined number of rotational degrees.

U.S. Pat. No. 4,949,866 ('866 Patent), which issued to Sanders, also discloses a Refuse Container Cover. The Sanders Refuse Container Cover discloses an integrally-joined, two-piece, coplanar cover comprising an upper member having a plurality of unidirectional parallel ribs and a lower member having a plurality of unidirectional parallel ribs, which lower member ribs are generally perpendicular to the upper member ribs. The '866 Patent further discloses means for movably attaching the Refuse Container Cover to a refuse container and a generally arcuate upper surface to facilitate rainwater runoff. The '866 Patent also does not disclose a container lid having integral, laterally-aligned support rib elements and longitudinally-aligned support rib elements in a single walled container lid. Further, the '866 Patent does not disclose a container lid in combination with a side-mounted hinge assembly for preventing the container lid from pivoting beyond a predetermined number of rotational degrees.

U.S. Pat. No. 5,423,448 ('448 Patent), which issued to Pedigo, discloses a Dumpster-type Cylindrical Trash Container. The Dumpster-type Cylindrical Trash Container comprises half lid sections having first and second surfaces. Portions of the first surfaces further comprise a plurality of spaced, parallel rib elements thus forming intermittent first surface gaps. Further, portions of the second surfaces comprise a plurality of spaced, parallel rib elements also forming intermittent second surface gaps such that the second surface rib elements are opposing the first surface gaps and the first surface rib elements are opposing the second surface gaps. The lid sections further comprise means for hingedly affixing each lid section to the Dumpster-type Cylindrical Trash Container. The '448 Patent does not disclose a container lid having integral, laterally-aligned support rib elements and longitudinally-aligned support rib elements in a single walled container lid. Further, the '448 Patent does not disclose a container lid in combination with a side-mounted hinge assembly for preventing the container lid from pivoting beyond a predetermined number of rotational degrees.

U.S. Pat. No. 5,868,267 ('267 Patent), which issued to Taylor, discloses a Refuse Container Lid. The Refuse Container Lid comprises a plurality of lid members, a pivotal attaching mechanism, and a cam-shaped lobe integrally formed on each lid member. The lid members each include a pivoting edge, a curved edge, and a surface complementary to at least a portion of an upper surface of a refuse container. Each lid member includes a curved inner surface bound on opposing ends thereof by the pivoting edge and the curved edge. The pivotal attaching mechanism is adapted to attach the pivoting edges to the upper surface at a predetermined distance therefrom. The cam-shaped lobes are formed on the pivoting edge of each lid member and adapted to allow a pivotal motion of each lid member relative to the container and to contact the upper surface at a predetermined angle between the complementary surfaces and the upper surface, with the predetermined angle depending upon the predetermined distance and the shape of the lobes. Further, the '267 Patent discloses lid members having unidirectional rib structure.

It will thus be seen that the '267 Patent does not disclose a container lid having integral, laterally-aligned support rib elements and longitudinally-aligned support rib elements in a single walled container lid. Furthermore, while the cam-shaped lobe feature attempts to provide a mechanism to prevent the container lid from pivoting beyond a predetermined number of rotational degrees, the lobes must be properly aligned a predetermined distance from the upper surface, requiring labor intensive installation. Further, the shape of each cam-shaped lobe is critical to achieve proper function of the '267 Patent. With use, the shape of each cam-shaped lobe tends to quickly wear and deform, thus compromising the operability of the '267 Patent. A lid and hinge assembly is therefore needed that can be easily installed and which assembly is more resistant to harsh physical conditions of refuse transfer.

U.S. Pat. No. 5,975,345 ('345 Patent), which issued to Taylor, discloses a Lid Assembly Including Pivotally-Attached Lid Prop Member. The Lid Assembly Including Pivotally-Attached Lid Prop Member assembly comprises lid members that are side pivotally attached to the upper surface of a refuse container, a lid prop, and a mechanism for pivotally attaching the lid prop to the container. When pivoted to a lid supporting position, a lid-supporting surface of the lid prop contacts the bottom surface of the lid member and a flange of the lid prop faces the front surface of the lid member. The lid prop is pivotally coupled to the refuse container such that gravity forces the flange toward the front surface of the lid member when the container is in its upright position. Further, the '345 Patent discloses lid members having unidirectional rib structure.

It will thus be seen that the '345 Patent does not disclose a container lid having integral, laterally-aligned support rib elements and longitudinally-aligned support rib elements in a single walled container lid. Further, while the cam-shaped lobe feature of the '345 Patent also attempts to provide a mechanism to prevent the container lid from pivoting beyond a predetermined number of rotational degrees, the lobes must be properly aligned a predetermined distance from the upper surface, requiring labor intensive installation. Further, the shape of each cam-shaped lobe is critical to achieve proper function of the '345 Patent. With use, the shape of each cam-shaped lobe tends to quickly wear and deform, thus compromising the operability of the '345 Patent. A lid and hinge assembly is therefore needed that can be easily installed and which assembly is more resistant to harsh physical conditions of refuse transfer.

U.S. Design Patent No. D226,328 ('328 Patent), which issued to Patton, discloses a Cover For Trash Receptacle that is a rear-pivoting garbage can lid having planar rib reinforcement that runs along the same plane and in both the longitudinal and latitudinal directions. However, the longitudinal ribs of the '328 Patent are located along the interior of the lid while the latitudinal ribs are located along the perimeter of the lid. It will thus be seen that the '328 Patent does not disclose a container lid having integral, laterally-aligned support rib elements and longitudinally-aligned support rib elements in a single walled container lid, which support rib elements form U-shaped support ribs.

U.S. Design Patent No. D362,325 ('325 Patent), which issued to Taylor, and which was assigned to Container Components, Inc., does disclose perpendicular rib reinforcement having laterally-aligned and longitudinally-aligned support ribs. However, the latitudinal ribs appear to surround the longitudinal ribs and are also shown to be located on a second, parallel plane. It will thus be seen that the '325 Patent does not disclose a container lid having integral, laterally-aligned support rib elements and longitudinally-aligned support rib elements in a single walled container lid, which support rib elements form U-shaped support ribs.

U.S. Pat. No. 4,558,799 ('799 Patent), which issued to Hammond, discloses a Container With Hinged Lid. The Container With Hinged Lid discloses a large capacity, molded refuse container having a lid comprised of two identical, overlapping cover elements. The cover elements are each pivotally interconnected to the container by a molded hinge means, which includes a hinge pin passing through an integral sleeve molded into the hinge. Portions of the hinge pin are exposed to allow the hinge pin to function as a handle. It will be seen that the '799 Patent does not disclose a container lid having integral, laterally-aligned support rib elements and longitudinally-aligned support rib elements in a single walled container lid. The '799 Patent further does not disclose a container lid in combination with a side-mountable hinge assembly for use in conjunction large capacity metal refuse containers, which hinge assembly has improved, simplified mechanical structure for preventing the container lid from pivoting beyond a predetermined number of rotational degrees.

SUMMARY OF THE INVENTION

Accordingly, the driving objective of the present invention is to provide an improved refuse container lid and hinge assembly for use in conjunction with large capacity commercial refuse containers of the front-loading, overhead-emptying type. In this regard one objective of the present invention is to provide a refuse container lid having integral, laterally-aligned support rib elements and longitudinally-aligned support rib elements in a single-walled container lid. A further objective of the present invention is to provide a single-walled container lid with integral, laterally-aligned support rib elements and longitudinally-aligned support rib elements, which rib elements form improved, uniquely configured U-shaped rib support elements. Another objective of the present invention is to provide a refuse container lid, which lid further comprises a crumple region thus allowing the lid to reversibly flex when subjected to planar compressive forces. Yet another objective of the present invention is to provide a refuse container lid with a primary support region, which region allows the lid to support massive loads placed atop the lid when in a closed position or to withstand nonplanar compressive forces. Yet another objective of the present invention is to provide an improved lid in combination with an improved, easily installed hinge assembly. In this regard, an additional objective of the present invention is to provide a hinge assembly with improved, simplified mechanical stop structure for preventing the refuse container lid from pivoting beyond a preferable, predetermined number of rotational degrees. Still further, another objective of the present invention is to provide a refuse container lid and hinge assembly, which assembly comprises compression-type knuckles and tension-type knuckles for improving lid life and overall performance, particularly in the event the lid is forced to pivot beyond the preferred, predetermined number of rotational degrees.

To attain these objectives, the claimed invention generally comprises two longitudinally-aligned angled members attached to the perimeter support surface of a refuse container laterally opposite in parallel relation to one another. The angled members each further comprise a substantially horizontal attachment portion, a substantially vertical stop portion, and a plurality of integrally-mounted, longitudinally-spaced, longitudinally-aligned hinge rod receiving knuckles.

The claimed invention further comprises two lid members, the lid members each comprising a substantially planar structure with a medial closure edge, a lateral pivot portion, an anterior contact edge, and a posterior contact edge. A crumple region lies adjacent the medial closure edge and extends laterally and a support region lies adjacent the lateral pivot portion and extends medially. Both the crumple regions and support regions allow the lid members to withstand nonplanar compressive forces; the crumple region also allowing the lids to reversibly flex should the lid be subjected to planar compressive forces. The support regions each further comprise a plurality of raised, U-shaped, support ribs, which ribs effect a patterned series of sloped superior surfaces and a patterned series of sloped inferior surfaces.

Additionally, the claimed invention further comprises two hinge rods for hingedly connecting the lid members to the angled members. The lid members are formed such that the lids are allowed a pivotal range of motion about axes of rotation extending through the hinge rods. The pivotal ranges of motion are structurally limited between a closed position, wherein anterior and posterior contact edges seat on the perimeter support surface of the refuse container, to an open position wherein stop structures of the lid members contact the vertical stop portions thus restricting the lid members from pivoting more than a preferred, predetermined number of rotational degrees from the closed position.

BRIEF DESCRIPTION OF THE DRAWINGS

Other features of our invention will become more evident from a consideration of the following detailed description of my patent drawings, as follows.

DETAILED DESCRIPTION OF THE PREFERRED EMBODIMENT

PREFERRED EMBODIMENT

Figure 1:
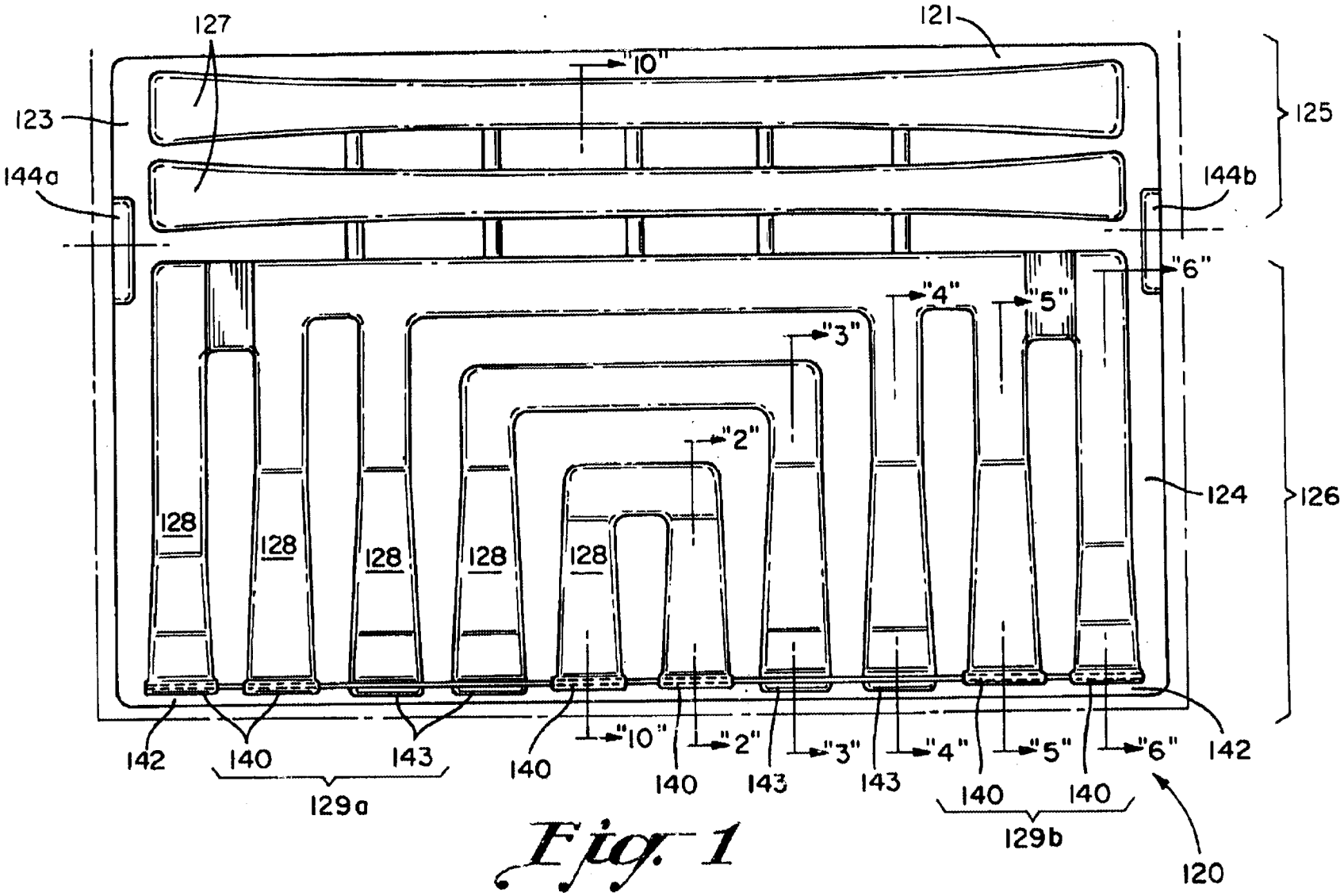
FIG. 1 is a right lateral top plan view of the right lid member.
Figure 6:
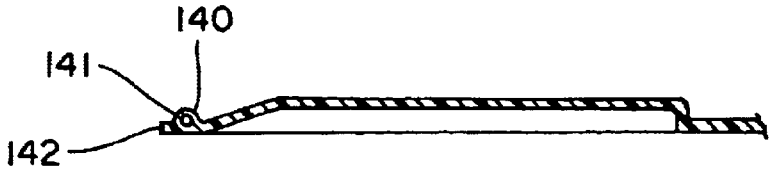
FIG. 6 is a cross-sectional view of the outermost leg portion of the right posterior W-shaped support rib.
Figure 7:
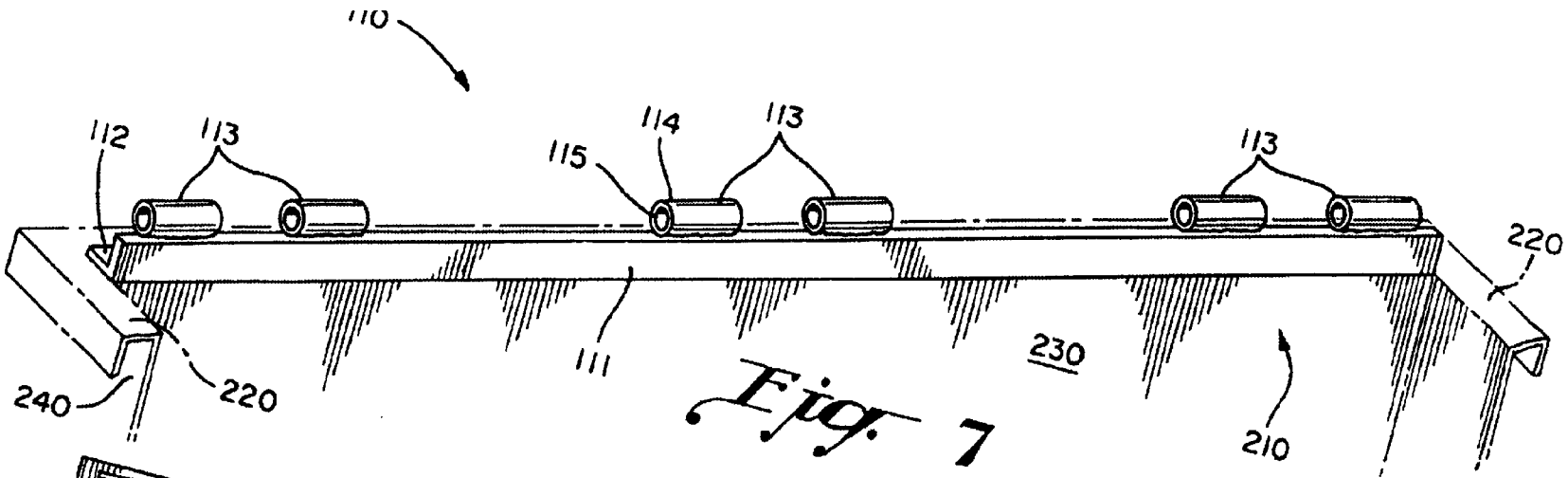
FIG. 7 is a fragmentary perspective view of the left angled member attached to the perimeter support surface of a refuse container.
Figure 8:
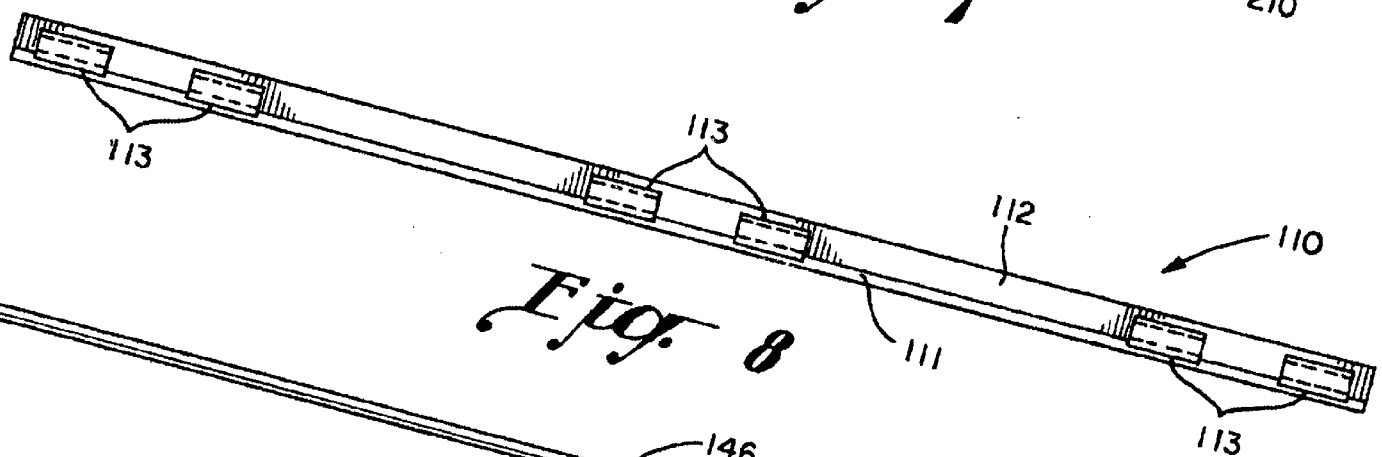
FIG. 8 is a top plan view of the left angled member.
Figure 9:
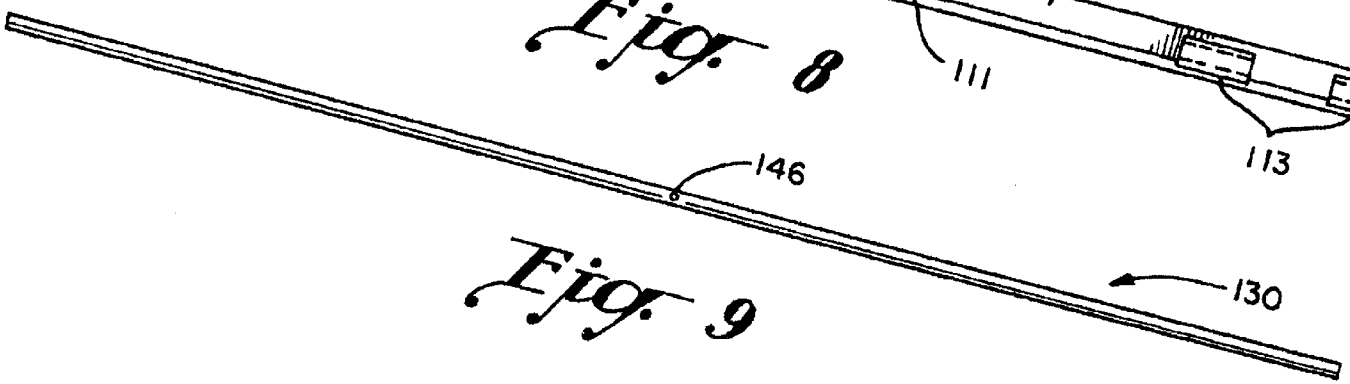
FIG. 9 is a top plan view of one hinge rod.

Referring now to the drawings, the preferred embodiment of the present invention, namely, the refuse container lid and hinge assembly for use in conjunction with a refuse container is generally illustrated in FIGS. 1–14, inclusive. The preferred embodiment of the refuse container lid and hinge assembly generally comprises two identical angled members 110. Angled members 110, when assembled in connection with a refuse container and viewed from a front or anterior viewpoint, are spatially oriented such that there is one left angled member 110 and one right angled member 110, which members are mirror images of each other. The left angled member 110 is generally shown in FIG. 7 and FIG. 8. The refuse container lid and hinge assembly further comprises two identical lid members 120. Lid members 120, when assembled in connection with a refuse container and viewed from an anterior viewpoint, are spatially oriented such that there is one left lid member 120 and one right lid member 120, which members are also mirror images of each other. The right lid member 120 is generally shown in FIG. 1. Both lid members 120 are further shown in FIG. 12 and FIG. 13. The refuse container lid and hinge assembly further comprises two identical hinge rods 130. Hinge rods 130, when assembled in connection with a refuse container and viewed from an anterior viewpoint, are spatially oriented such that there is one left hinge rod 130 and one right hinge rod 130, which rods are also mirror images of one another. One hinge rod 130 is generally illustrated in FIG. 9. The right hinge rod is specifically illustrated in FIG. 11 and FIG. 14.

Figure 12:
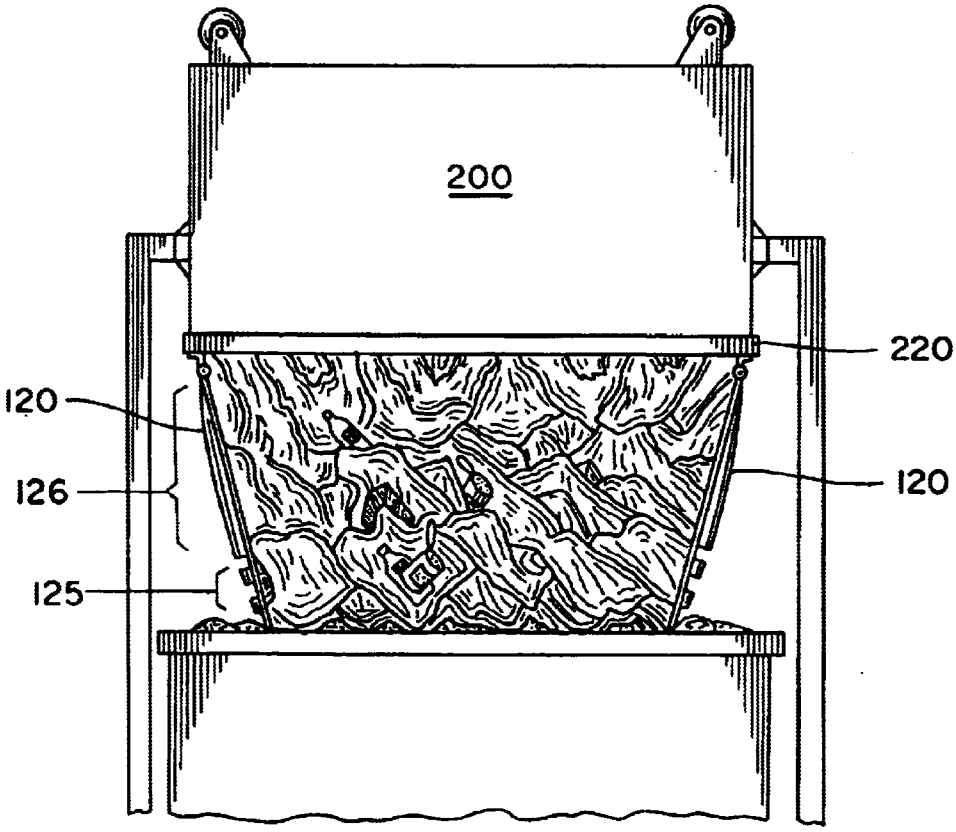
FIG. 12 is a fragmentary depiction of the refuse container being emptied, each lid member being pivoted to a fully open position.
Figure 13:
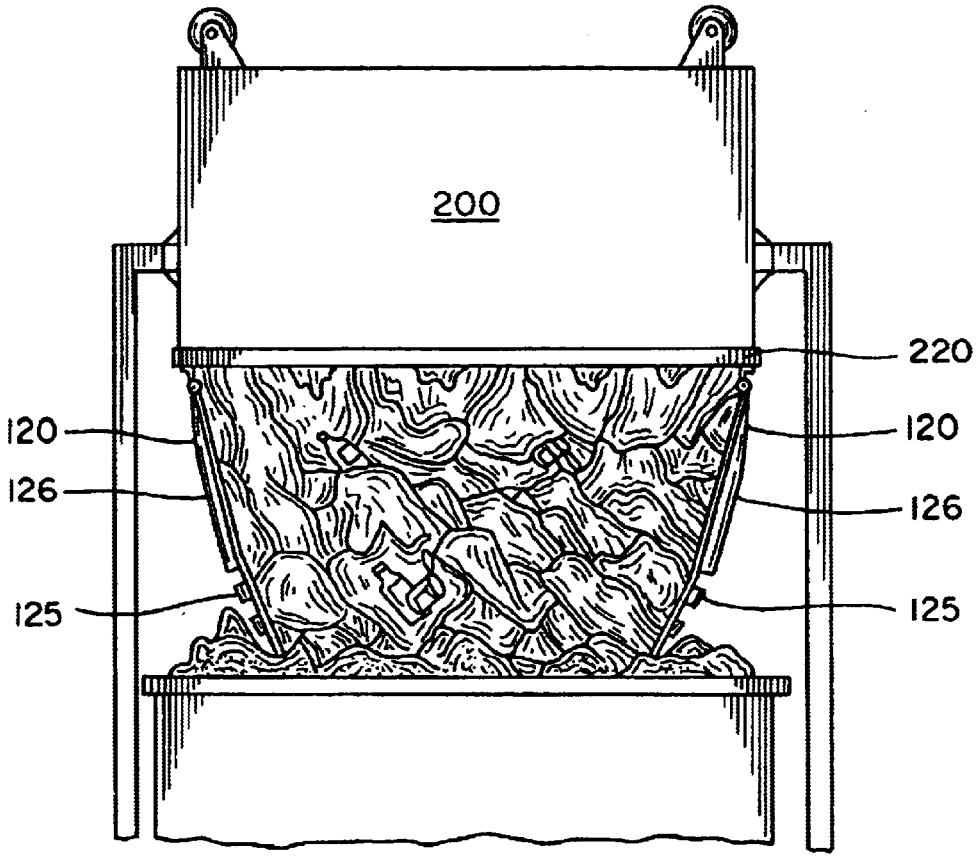
FIG. 13 is a fragmentary depiction of the refuse container being emptied, each lid member being pivoted to a fully open position with crumple region contacting compacted trash and flexing accordingly.

It is noted that most commercial refuse containers of the front-loading, overhead-emptying type, such as the refuse container 200 as generally shown in FIG. 12 and FIG. 13, comprise a primary opening 210 as specifically shown in FIG. 7. Preferably, primary opening 210 comprises a perimeter support surface 220, which perimeter support surface 220 is contiguous with an interior container surface 230 and an exterior container surface 240. In the preferred embodiment, the preferred embodiment of the refuse container lid and hinge assembly attaches to a commercial refuse container having surfaces to which additional structure may be welded.

Angled members 110 are preferably comprised of angle iron as this type of structural material is less costly, sturdy and may be easily worked with to achieve desired results.

Angled members 110 each further comprise a vertical stop portion 111 and a horizontal attachment portion 112. Horizontal attachment portions 112 preferably measure 1 inch wide, vertical stop portions preferably measure 1 inch high, and the angle therebetween is preferably a substantially right angle as most clearly shown in FIG. 11. The thickness of the angle iron material preferably measures 3/16 inch. The length of the angled members preferably measures 53 inches. Angled members 110 further comprise hinge rod receiving knuckles 113. Hinge rod receiving knuckles are preferably comprised of 1 inch diameter circular pipe sections as this type of structural material is also less costly, sturdy and may be easily worked with to achieve desired results. Hinge rod receiving knuckles 113 each further comprise an exterior nesting surface 114 and an interior hinge rod receiving surface 115 as shown in FIG. 7. Preferably, there are six hinge rod receiving knuckles 113 longitudinally spaced as shown in FIG. 7.

It is further noted that when constructed, commercial refuse containers are most often preferably formed to approximate a rectangular, box-like shape, with opposite sides being joined at 90 degree angles at the corners of the box-like structure. However, in the course of repeated waste transfer from the refuse containers to front-loading, overhead-emptying waste disposal vehicles, the refuse containers become damaged to varying extents and the opposite sides become reconfigured such that the comers of the refuse container often deviate from the preferred 90 degree angles. The present invention has been developed in response to this noted problem such that angled members 110 are preferably longitudinally-aligned and fixedly attached to perimeter support surface 220 laterally opposite and in parallel relation to one another. While the longitudinally-aligned, lateral walls of a given preexistent refuse container may not be parallel, angled members 110 may nevertheless be fixedly attached in parallel relation to one another such that vertical stop portions 111 are substantially flush with interior container surfaces 230 or positioned so as to place vertical stop portions 111 in as much flush relation to vertical stop portion 111 as is possible, as is further shown in FIG. 7. Horizontal attachment portions 112 are then preferably welded to perimeter support surface 220 when the installation technician has determined the desired parallel placement. Installation is quick and easy, requiring little precision in measurement, which represents an improvement over prior art dependent on precise measurement and complex installation practice for proper operation.

Since most commercial refuse containers of the front-loading, overhead-emptying type measure 74 inches from the left side (left lateral side) to the right side (right lateral side) and 57 inches from front (anterior side) to rear (posterior side), lid members 120 are preferably sized and shaped to substantially cover primary opening 210. Accordingly, each lid member 120 measures approximately 38 inches from the lateral edge to the medial edge and 57 inches from the anterior edge to the posterior edge. Each lid member 120 has an added inch in lateral dimension to provide a stop structure or stop lip as is described in more detail below. Preferably, lid members 120 each further comprise a substantially planar overall structure. Given the current state of materials art and molding art, lid members 120 are preferably comprised of vacuum molded High Density Polyethlylene to approximately 3/16 inch to 1/4 inch in thickness. It is contemplated that with significant developments in the state of these arts, the preferred materials and/or molding thickness may change, without changing the inventive nature of the present invention.

Figure 10:
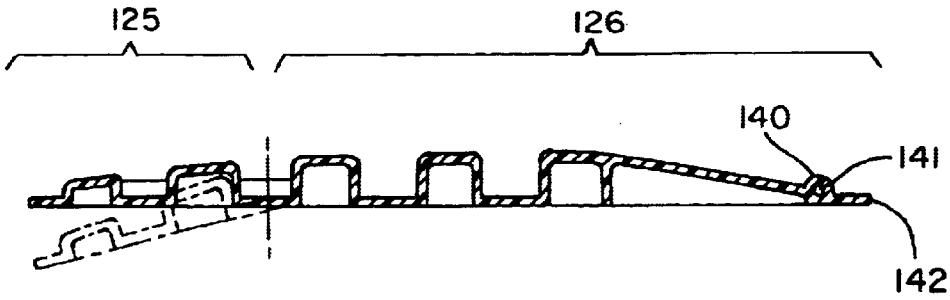
FIG. 10 is a cross-sectional view of one lid member showing operable crumple region flexibility in broken lines.

As noted, each lid member 120 is a mirror image of one another, further comprising a medial closure edge 121, a lateral pivot portion, an anterior contact edge 123, a posterior contact edge 124, a crumple region 125 adjacent medial closure edge 121 extending laterally, and a support region 126 adjacent the lateral pivot portion extending medially all as shown in FIG. 1. Medial closure edges 121 preferably do not overlap, but lie in flush adjacency to one another when lid members 120 are in a closed position. Crumple regions 125 allow lid members 120 to reversibly flex should the general planar structure of lid members 120 be exposed to planar compressive forces as shown in FIG. 10 and FIG. 13. For example, refuse container lid structures are often exposed to planar compressive forces when refuse containers are brought into close contact with compacted trash piled high inside the transfer compartments of waste transfer vehicles. The planar structure of refuse container lids often violently contact compacted trash and accordingly often fail or are severely damaged, thus requiring costly replacement. Crumple regions 125 thus have been designed to allow lid members 120 to flex at a point between crumple regions 125 and support regions 126, which flexing feature improves the life of lid members 120, thus reducing the need for replacement lid structures. It is further contemplated that crumple regions 125 further have a preferable crumple region width and support regions 126 further have a preferable support region width. The ration of crumple region width to support region width preferably approximates 1:7/3, which ratio effects the preferred structural design in terms of support strength and crumple region flexibility.

Crumple regions 125 each further preferably comprise a plurality of raised, longitudinal support ribs 127 and support regions 126 each further preferably comprise a plurality of raised, U-shaped support ribs 128. U-shaped support ribs 128 are further preferably configured and uniquely patterned such that a plurality thereof are leg-sharing as shown in FIG. 1. Further, U-shaped support ribs 128 specifically comprise, in part, concentrically-nested, U-shaped support ribs 128 as also shown in FIG. 1. The concentrically-nested, U-shaped support ribs 128 are preferably positioned intermediate a posterior W-shaped support rib 129(*b*) adjacent posterior contact edge 124 and an anterior W-shaped support rib 129(*a*) adjacent anterior contact edge 123. The concentrically-nested, U-shaped support ribs 128 further comprise an outermost support rib, an intermediate support rib, and an innermost support rib, which outermost support rib shares a leg with anterior W-shaped support rib 129(*a*) and posterior W-shaped support rib 129(*b*) as shown in FIG. 1. Anterior W-shaped support ribs 129(*a*) are purposefully positioned adjacent anterior contact edge 123 to provide more structural strength at the anterior most portion of lid members 120. Similarly, posterior W-shaped support ribs 129(*b*) are purposefully positioned adjacent posterior contact edge 124 to provide more structural strength at the posterior most portion of lid members 120. Lid members 120 are thus better adapted to withstand wear at the anterior and posterior contact points, thus leading to a decreased need for replacement refuse container lids. It should be noted that W-shaped support ribs 129(*a*) and 129(*b*), as introduced and described above, are essentially two side-by-side, U-shaped support ribs 120, which U-shaped support ribs share an intermediate leg portion.

Given the state of molding art, crumple regions 125 each further preferably comprise two laterally-spaced, longitudinal support ribs and the support regions each further comprise seven U-shaped support ribs. It is contemplated that with developments in the state of molding art, the number of longitudinal support ribs 127 and the number of U-shaped support ribs 128 may vary. Currently, the number of longitudinal support ribs 127 and the number of U-shaped support ribs 128 represents the preferred number of support ribs which can be vacuum molded and made of high density polyethylene and which can achieve the desired results. Increasing the number of support ribs on either the crumple region 125 or the support region 126 compromises the structural integrity of lid members 120 insofar as the preferred thickness of the vacuum molded high density polyethylene becomes less uniform as the number of support ribs increases. It is contemplated that with significant developments in the state of molding art such that the preferred thickness of the vacuum molded high density polyethylene may remain more uniform independent of the number of support ribs, that the number of respective support ribs may be increased accordingly.

It will thus be seen that longitudinal support ribs 127 and U-shaped support ribs 128 allow lid members 120 to withstand significant nonplanar compressive forces or forces directed against the plane in which lid members 120 substantially lie. By way of a common example, lid members 120 may withstand the resultant downward forces directed at lid members 120 when a person of at least 170 pounds stands atop lid members 120 with one foot on each of the two medial most longitudinal support ribs 127.

It will also be seen that longitudinal support ribs 127 and U-shaped support ribs 128 further effect a patterned series of sloped superior surfaces, which provide means for allowing surface-located matter to transition from a point of superior potential energy to a point of inferior potential energy. The superior surfaces further transition to a patterned series of sloped inferior surfaces, the inferior surfaces providing further means for allowing surface-located matter to transition from a point of superior potential energy to a point of inferior potential energy, namely exterior container surface 240.

Each U-shaped support rib 128 has a longitudinally-aligned base portion and two laterally-aligned leg portions. The leg portions each extend laterally to the lateral pivot portions, which leg portions terminate in a pivot portion terminus. A plurality of the pivot portion termini have longitudinally-aligned hinge rod receiving apertures 141 intermediate the superior and inferior surfaces as shown in FIG. 2, FIG. 5, FIG. 6, and FIG. 10.

Figure 14:
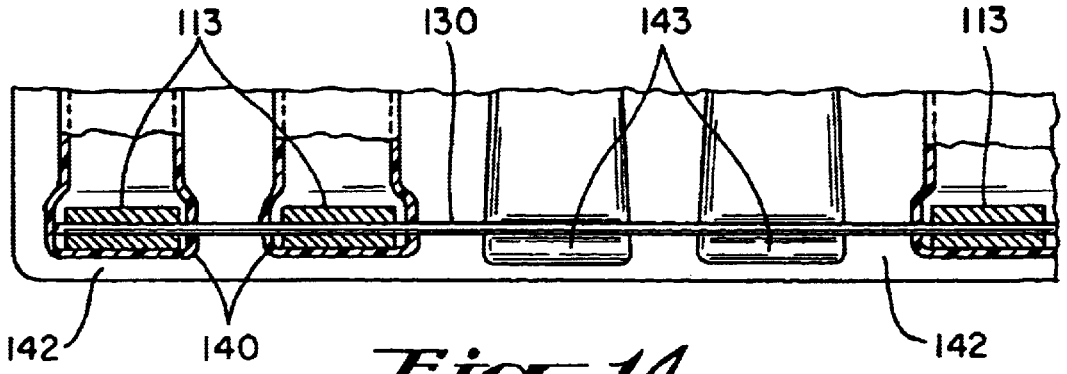
FIG. 14 is a fragmentary right lateral top plan view of the right anterior lateral pivot portion with parts broken away to show lid member attachment to hinge assembly.

Hinge rods 130 are preferably each made of zinc-plated steel rods measuring 57 inches in length and ¾ inch in diameter. Hinge rods 130 hingedly connect lid members 120 to angled members 110 by placing a plurality of the pivot portion termini over a plurality of hinge rod receiving knuckles 113. A plurality of the pivot portion termini are preferably sized and shaped to nestedly receive exterior nesting surfaces 114 as is generally shown in FIG. 14. Hinge rod receiving surfaces 115 and hinge rod receiving apertures 141 are thus longitudinally aligned to receive hinge rods 130. Hinge rods 130 can then be easily inserted through the hinge rod receiving surfaces 115 and hinge rod receiving apertures 141 thus hingedly connecting lid members 120 to angled members 110.

Figure 11:
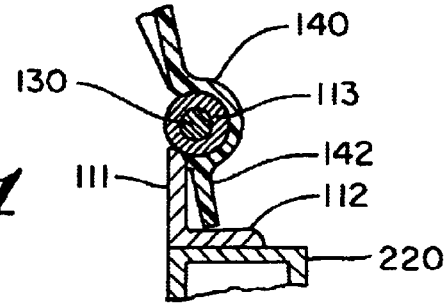
FIG. 11 is a fragmentary cross-sectional view of one lid member and hinge assembly.

At the lateral most edge of each lateral pivot portion is a longitudinal stop lip 142 as introduced above and as shown in FIG. 1, FIG. 2, FIG. 3, FIG. 4, FIG. 5, FIG. 6 FIG. 10, FIG. 11 and FIG. 14. Longitudinal stop lips 142 each have a stop lip width, which preferably measures ⅝ inches from a pivot axis of rotation extending through each hinge rod 130 to the lateral most edge of the lateral pivot portion. Longitudinal stop lips 142 are formed such that lid members 120 are allowed a pivotal range of motion about the axes of rotation extending through hinge rods 130. The pivotal ranges of motion, however, are generally limited between a closed position wherein anterior contact edge 123 and posterior contact edge 124 seat on perimeter support surface 220 to an open position wherein longitudinal stop lips 142 contact angled members 110, as shown in FIG. 11, thus generally restricting lid members 120 from pivoting more than 90 degrees from the closed position.

In the preferred embodiment, hinge rod receiving knuckles 113 are integrally mounted atop vertical stop portion 111 by welding the respective pipe sections to the angle iron structure. When the right angled member 110 and right set of hinge rod receiving knuckles 113 are viewed from an extreme anterior viewpoint as is shown in FIG. 11, it will be seen that the right set of hinge rod receiving knuckles 113 are preferably attached to the right vertical stop portion at about 225 rotational degrees or $5\pi/4$ radians from the zero point of the right hinge rod receiving knuckles 113 unit circular structure. Similarly, were the left angled member 110 and left set of hinge rod receiving knuckles 113 to be viewed from an extreme anterior viewpoint (not shown), it would be seen that the left set of hinge rod receiving knuckles 113 are preferably attached to the left vertical stop portion at about 315 rotational degrees or $7\pi/4$ radians from the zero point of the left hinge rod receiving knuckles 113 unit circular structure. As described above, angled members 110 are spatially oriented to approximate mirror images of one another. Integrally mounting hinge rod receiving knuckles 113 in this manner thus allows lid members 120 a limited pivotal range of motion about the axis of rotation extending through hinge rods 130. The pivotal ranges of motion are thus preferably limited between a closed position wherein anterior contact edge 123 and posterior contact edge 124 seat on perimeter support surface 220 to an open position wherein longitudinal stop lips 142 contact angled members 110, thus restricting lid members 120 from pivoting more than about 75 degrees from the closed position as is shown in FIG. 12 and FIG. 13. By thus restricting lid members 120 from pivoting beyond 75 degrees from the closed position, the present invention helps eliminate a common cause for lid failure. In this regard, it is noted that refuse container lid systems disclosed in the prior art comprise lid elements which often come into violent contact with the waste transfer vehicles and/or compacted trash inside the transfer compartments of waste transfer vehicles and accordingly fail. The lid elements are often forced beyond the preferred range of pivotal motion by this violent contact and frequently fail.

It will be seen in the preferred embodiment from that each longitudinal stop lip 142 simultaneously contacts the respective horizontal attachment portion 112 and vertical stop portion 111 to stop lid members 120 from pivoting more than 75 degrees from the closed position. It is contemplated that with repeated operation, longitudinal stop lips 142 will wear from repeated stopping contact with horizontal attachment portions 112, thus becoming shorter in measured width, resulting in ever increasing pivotal ranges of motion. It will be further seen, however, that longitudinal stop lips 142 will always contact vertical stop portions 111, which prevent lid members 120 from pivoting more than 90 degrees from the closed position.

Figure 2:
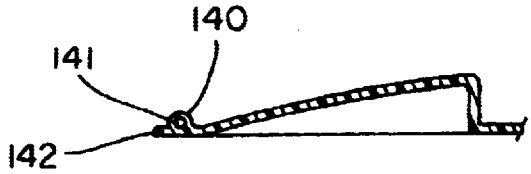
FIG. 2 is a cross-sectional view of one leg portion of the innermost U-shaped support rib.
Figure 3:
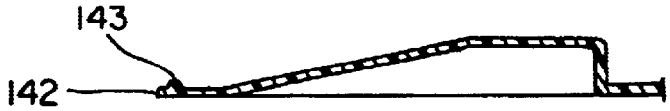
FIG. 3 is a cross-sectional view of one leg portion of the intermediate U-shaped support rib.
Figure 4:
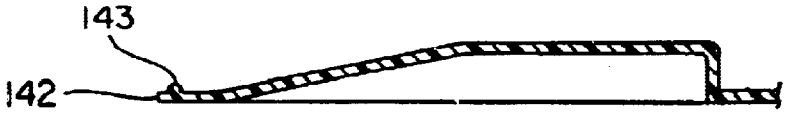
FIG. 4 is a cross-sectional view of the shared leg portion of the outermost U-shaped support rib and innermost leg of the right posterior W-shaped support rib.
Figure 5:
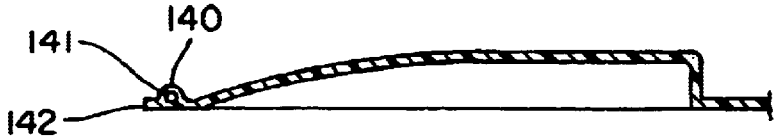
FIG. 5 is a cross-sectional view of the intermnediate leg portion of the right posterior W-shaped support rib.

In the preferred embodiment, angled members 110 are each further defined by comprising a pair of posterior hinge rod receiving knuckles 113, a pair of central hinge rod receiving knuckles 113, and a pair of anterior hinge rod receiving knuckles 113 as is shown in FIG. 7 and FIG. 8. It will be further seen that the pivot portion termini of posterior W-shaped support ribs 129(*b*) and anterior W-shaped support ribs 129(*a*) are each further defined by comprising two compression-type knuckles 140 as shown in FIG. 1, FIG. 5 and FIG. 6, and one tension-type knuckle 143 as shown in FIG. 1 and FIG. 4. Tension-type knuckles 143 further comprise the pivot portion termini of the outermost U-shaped support rib, the legs of which are shared with the innermost legs of W-shaped support ribs 129(*a*) and 129(*b*) as is shown in FIG. 1 and FIG. 4. It will be further seen that the pivot portion termini of the intermediate U-shaped support ribs are each further defined by comprising tension-type knuckles 143, as is shown in FIG. 1 and FIG. 3, and that the pivot portion termini of the innermost U-shaped support rib are each further defined by comprising compression-type knuckles 140, as is shown in FIG. 1 and FIG. 2.

As indicated, a common shortcoming inherent in the use of front-loading, overhead-emptying refuse containers and the associated pivoting lid portions is that the lid portions will often be forced to failure by either violently contacting compacted trash piled high in the transfer compartments of the waste transfer vehicles or by violently contacting the upright walls of the transfer compartments. As a means to help absorb and dissipate these lid damaging forces, which often cause pivoting lid portions to pivot beyond 90 rotational degrees from a closed position, compression-type knuckles 140 and tension-type knuckles 143 cooperate to dissipate a portion of the forces thus acting on the lateral pivot portions. Compression-type knuckles 140 are nestedly associated with hinge rod receiving knuckles 113 as shown in FIG. 14 and further allow the lateral pivot portions to withstand certain compressive-type forces should lid members 120 be pivoted more than about 75 degrees from a closed position. Tension-type knuckles 143 are cooperatively associated with hinge rods 130 as further shown in FIG. 14 and allow the lateral pivot portions to withstand certain tensile-type forces should lid members 120 be pivoted more than 75 degrees from a closed position. Compression-type knuckles 140 and tension-type knuckles 143 thus cooperatively act to aid in the prevention of lateral pivot portion failure.

In the preferred embodiment, the present refuse container and hinge assembly further has means for preventing hinge rods 130 from sliding from hinged position. Preferably, the means for preventing hinge rods from sliding from hinged position comprises hinge rod cotter pin receiving structure 146 as well as lid member cotter pin receiving structure. Hinge rod cotter pin receiving structure 146 is achieved by making a diametrical bore through each hinge rod 130 at a point intermediate the hinge rod ends. As shown in FIG. 9, hinge rod cotter pin receiving structure 146 is most preferably located mid-length hinge rod 130. The lid member cotter pin receiving structure is achieved by making a bore in a lid member 120 at the lateral pivot portion, which bore is aligned with hinge rod cotter pin receiving structure 146. Cotter pins may then be easily inserted through aligned cotter pin receiving structures and flared to prevent hinge rods 130 from sliding from hinged position.

As an additional feature for refuse container loading convenience, lid members 120 each have means for manually opening lid members 120 while refuse container 200 is in a refuse containing position. Preferably, the means for manually opening lid members is further defined by comprising two raised, substantially hand-sized lifting structures. One anterior lifting structure 144(*a* ) extends along anterior contact edge 123 from the medial most portion of support region 126 to the lateral most portion of crumple region 125 as shown in FIG. 1. One posterior lifting structure 144(*b* ) extends along the posterior contact edge 124 from the medial most portion of support region 126 to the lateral most portion of crumple region 125 as further shown in FIG. 1. Anterior lifting structures 144(*a* ) and posterior lifting structure 144(*b* ) thus enable users to more easily lift lid members 120 so that trash may be more easily inserted into primary opening 210.

The reader will thus see that the driving objective of the present invention is to provide an improved refuse container lid and hinge assembly for use in conjunction with large capacity commercial refuse containers of the front-loading, overhead-emptying type. The present invention discloses a refuse container lid having integral, laterally-aligned support rib elements and longitudinally-aligned support rib elements in a single-walled container lid. It will be further seen that the present invention discloses a single-walled container lid with integral, laterally-aligned support rib elements and longitudinally-aligned support rib elements, which rib elements form improved, uniquely configured U-shaped rib support elements. Yet further, it will be seen that the present invention discloses a refuse container lid, which lid further comprises a crumple region thus allowing the lid to reversibly flex when subjected to planar compressive forces. The present invention further discloses a refuse container lid with support regions, which regions allow the lid to support massive loads placed atop the lid when in a closed position or to withstand nonplanar compressive forces. Furthermore, the present invention discloses an improved lid in combination with an improved, easily installed hinge assembly. In this regard, it will be seen that the present invention discloses a hinge assembly with improved, simplified mechanical stop structure for preventing the refuse container lid from pivoting beyond a preferable, predetermined number of rotational degrees. Still further, it will be noted that present invention discloses a refuse container lid and hinge assembly, which assembly comprises compression-type knuckles and tension-type knuckles for improving lid life and overall performance, particularly in the event the lid is forced to pivot beyond the preferred, predetermined number of rotational degrees.

It is contemplated that the refuse container lid and hinge assembly herein illustrated and described is used primarily for descriptive and illustrative purposes and should not be construed to limit the scope of concept application to the application as shown. For example, it is contemplated that the longitudinal stop lips may be molded at inferior angles to the plane in which the lid members substantially lay and hinge rod receiving knuckles may be welded to the angle iron structures at different unit circular positions than the preferably stated unit circle locations. By way of further description, it is contemplated that the longitudinal stop lips may each be differently formed such that the lid members are allowed a 75 degree pivotal range of motion about the axes of rotation extending through hinge rods 130. In this regard, the longitudinal stop lips may be molded such that the longitudinal stop lips are angled 15 degrees inferior to the plane in which the lid members substantially lay. It is contemplated that in this alternative embodiment, the hinge rod receiving knuckles would be integrally mounted atop the respective vertical stop portions by welding the respective pipe sections to the angle iron structure such that the hinge rod receiving knuckles are preferably attached to the vertical stop portions at about 270 rotational degrees or $3\pi/2$ radians from the zero point of the hinge rod receiving knuckles unit circular structure. Integrally mounting the hinge rod receiving knuckles in this manner may thus require less installation time or skill in that the hinge rod receiving knuckles may more simply be welded atop the vertical stop portions such that the planes in which the vertical stop portions lay coincide with the planes which vertically bisect the hinge rod receiving knuckles. Molding the longitudinal stop lips to be angled 15 degrees inferior to the plane in which the lid members substantially lay, however, would require a more complex molding scheme, thus needlessly increasing molding costs when installation of the right hinge rod receiving knuckle at 225 degrees and the installation of the left hinge rod receiving knuckle at 315 degrees requires little added installation time or skill to complete.

Accordingly, although the invention has been described by reference to a preferred embodiment, it is not intended that the novel device be limited thereby, but that modifications thereof are intended to be included as falling within the broad scope and spirit of the foregoing disclosure, the following claims and the appended drawings.

I claim:

1. A combination lid, hinge and refuse container assembly for use in conjunction with a front-loading, overhead-emptying waste disposal apparatus, the combination lid, hinge and refuse container assembly comprising:

a refuse container, the refuse container having a primary opening, the primary opening having a perimeter support surface, the perimeter support surface being contiguous with an interior container surface, the perimeter support surface further being contiguous with an exterior container surface;

two longitudinally-aligned angled members attached to the perimeter support surface laterally opposite in parallel relation to one another, the angled members each comprising a substantially horizontal attachment portion, a substantially vertical stop portion, and a plurality of integrally-mounted, longitudinally-spaced, longitudinally-aligned hinge rod receiving knuckles, the vertical stop portions being substantially flush with the interior container surface, the hinge rod receiving knuckles each further comprising an exterior nesting surface and an interior hinge rod receiving surface;

two lid members, the lid members each comprising a substantially planar structure, the planar structure further comprising a medial closure edge, a lateral pivot portion, an anterior contact edge, a posterior contact edge, a crumple region adjacent the medial closure edge extending laterally, and a support region adjacent the lateral pivot portion extending medially, the crumple regions allowing the lid members to reversibly flex should the planar structure be exposed to planar compressive forces, the crumple regions each further comprising a plurality of raised, longitudinal support ribs, the support regions each further comprising a plurality of raised, U-shaped, support ribs, the longitudinal support ribs and the U-shaped support ribs allowing the lid members to withstand nonplanar compressive forces, the longitudinal support ribs and U-shaped support ribs effecting a patterned series of sloped superior surfaces and a patterned series of sloped inferior surfaces, each U-shaped support rib having a longitudinally-aligned base portion and two laterally-aligned leg portions, the leg portions each extending laterally to the lateral pivot portions terminating in a pivot portion terminus, a plurality of the pivot point termini having longitudinally-aligned hinge rod receiving apertures intermediate the superior and inferior surfaces, the lateral pivot portions each further comprising a longitudinal stop lip; and two hinge rods for hingedly connecting the lid members to the angled members, a plurality of the pivot portion termini being formed to nestedly receive the exterior nesting surfaces, the hinge rod receiving surfaces and hinge rod receiving apertures being longitudinally aligned to receive the hinge rods, the hinge rods being inserted through the hinge rod receiving surfaces and hinge rod receiving apertures, thus hingedly connecting the lid members to the angled members, the stop lips being formed such that the lid members are allowed a pivotal range of motion about the axes of rotation, the pivotal ranges of motion being limited between a closed position wherein the anterior and posterior contact edges seat on the perimeter support surface to an open position wherein the stop lips contact the angled members thus restricting the lid members from pivoting more than 90 degrees from the closed position.

2. The combination lid, hinge and refuse container assembly of claim 1 wherein the horizontal attachment portion measures at least 1 inch in width, the vertical stop portion measures at least 1 inch in height and the longitudinal stop lip measures at least 1 inch in width.

3. The combination lid, hinge and refuse container assembly of claim 1 wherein the hinge rod receiving knuckles are integrally mounted such that each lid member is allowed a pivotal range of motion about an axis of rotation, the pivotal ranges of motion being limited between a closed position wherein the anterior and posterior contact edges seat on the perimeter support surface to an open position wherein the stop lips contact the angled members thus restricting the lid members from pivoting more than about 75 degrees from the closed position.

4. The combination lid, hinge and refuse container assembly of claim 1 wherein the stop lips are each formed such that the lid members are allowed a pivotal range of motion about the axes of rotation, the pivotal ranges of motion being limited between a closed position wherein the anterior and posterior contact edges seat on the perimeter support surface to an open position wherein the stop lips contact the angled members thus restricting the lid members from pivoting more than about 75 degrees from the closed position.

5. The combination lid, hinge and refuse container assembly of claim 2 wherein the support regions each further comprise uniquely patterned, leg sharing U-shaped support ribs.

6. The combination lid, hinge and refuse container assembly of claim 5 wherein the uniquely patterned, leg sharing U-shaped support ribs further comprise concentrically-nested, U-shaped support ribs, the concentrically-nested, U-shaped support ribs being positioned intermediate a posterior W-shaped support rib adjacent the posterior contact edge and an anterior W-shaped support rib adjacent the anterior contact edge, the concentrically-nested, U-shaped support ribs further comprising an outermost support rib, an intermediate support rib, and an innermost support rib.

7. The combination lid, hinge and refuse container assembly of claim 6 wherein the crumple regions each further comprise two laterally-spaced, longitudinal support ribs and the support regions each further comprise seven U-shaped support ribs.

8. The combination lid, hinge and refuse container assembly of claim 7 wherein the angled members are each further defined by comprising a pair of posterior hinge rod receiving knuckles, a pair of central hinge rod receiving knuckles, and a pair of anterior hinge rod receiving knuckles.

9. The combination lid, hinge and refuse container assembly of claim 8 wherein the pivot portion termini of the posterior and anterior W-shaped support ribs are each further defined by comprising two compression-type knuckles and one tension-type knuckle, the tension-type knuckles comprising the pivot portion termini of the outermost support rib, the pivot portion termini of the intermediate support rib are each further defined by comprising tension-type knuckles, the pivot portion termini of the innermost support rib are each further defined by comprising compression-type knuckles, the compression-type knuckles being nestedly associated with the hinge rod receiving knuckles, the compression-type knuckles allowing the lateral pivot portions to withstand compressive forces should the lid members be pivoted more than about 75 degrees from a closed position, the tension-type knuckles being cooperatively associated with the hinge rods, the tension-type knuckles allowing the lateral pivot portions to withstand tensile forces should the lid members be pivoted more than about 75 degrees from a closed position, the compression-type knuckles and the tension-type knuckles thus cooperatively acting to aid in the prevention of lateral pivot portion failure.

10. The combination lid, hinge and refuse container assembly of claim 1 wherein the lid members each have means for manually opening the lid members while the refuse container is in a refuse containing position.

11. A combination lid and hinge assembly for use in conjunction with a refuse container, the refuse container having a perimeter support surface, the perimeter support surface defining a primary opening, the perimeter support surface being contiguous with an interior container surface, the combination lid and hinge assembly comprising:

two longitudinally-aligned angled members attached to the perimeter support surface laterally opposite in parallel relation to one another, the angled members each comprising a substantially horizontal attachment portion, a substantially vertical stop portion, and a plurality of integrally-mounted, longitudinally-spaced, longitudinally-aligned hinge rod receiving knuckles, the vertical stop portions being substantially flush with the interior container surface, the hinge rod receiving knuckles each further comprising an exterior nesting surface and an interior hinge rod receiving surface;

two lid members, the lid members each comprising a substantially planar structure, the planar structure further comprising a medial closure edge, a lateral pivot portion, an anterior contact edge, a posterior contact edge, a crumple region adjacent the medial closure edge extending laterally, and a support region adjacent the lateral pivot portion extending medially, the crumple regions allowing the lid members to reversibly flex should the planar structure be exposed to planar compressive forces, the crumple region having a crumple region width, the support region having a support region width, the crumple region width to support region width ratio being substantially 1:7/3, the crumple regions each further comprising a plurality of raised, longitudinal support ribs, the support regions each further comprising a plurality of raised, U-shaped, support ribs, the longitudinal support ribs and the U-shaped support ribs allowing the lid members to withstand nonplanar compressive forces, the longitudinal support ribs and U-shaped support ribs effecting a patterned series of sloped superior surfaces, the superior surfaces providing means for allowing surface-located matter to transition from a point of superior potential energy to a point of inferior potential energy, the superior surfaces transitioning to a patterned series of sloped inferior surfaces, the inferior surfaces providing further means for allowing surface-located matter to transition from a point of superior potential energy to a point of inferior potential energy, each U-shaped support rib having a longitudinally-aligned base portion and two laterally-aligned leg portions, the leg portions each extending laterally to the lateral pivot portions terminating in a pivot portion terminus, a plurality of the pivot point termini having longitudinally-aligned hinge rod receiving apertures intermediate the superior and inferior surfaces, the lateral pivot portions each further comprising a longitudinal stop lip; and two hinge rods for hingedly connecting the lid members to the angled members, a plurality of the pivot portion termini being formed to nestedly receive the exterior nesting surfaces, the hinge rod receiving surfaces and hinge rod receiving apertures being longitudinally aligned to receive the hinge rods, the hinge rods being inserted through the hinge rod receiving surfaces and hinge rod receiving apertures thus hingedly connecting the lid members to the angled members, the stop lips being formed such that the lid members are allowed a pivotal range of motion about the axes of rotation, the pivotal ranges of motion being limited between a closed position wherein the anterior and posterior contact edges seat on the perimeter support surface to an open position wherein the stop lips contact the angled members thus restricting the lid members from pivoting more than 90 degrees from the closed position.

12. The combination lid and hinge assembly of claim 11 wherein the horizontal attachment portion measures at least 1 inch in width, the vertical stop portion measures at least 1 inch in height and the longitudinal stop lip measures at least 1 inch in width.

13. The combination lid and hinge assembly of claim 11 wherein the hinge rod receiving knuckles are integrally mounted such that each lid member is allowed a pivotal range of motion about the axis of rotation, the pivotal ranges of motion being limited between a closed position wherein the anterior and posterior contact edges seat on the perimeter support surface to an open position wherein the stop lips contact the angled members thus restricting the lid members from pivoting more than about 75 degrees from the closed position.

14. The combination lid and hinge assembly of claim 11 wherein the stop lips are each formed such that the lid members are allowed a pivotal range of motion about the axes of rotation, the pivotal ranges of motion being limited between a closed position wherein the anterior and posterior contact edges seat on the perimeter support surface to an open position wherein the stop lips contact the angled members thus restricting the lid members from pivoting more than about 75 degrees from the closed position.

15. The combination lid and hinge assembly of claim 11 wherein the support regions each further comprise uniquely patterned, leg sharing, U-shaped support ribs.

16. The combination lid and hinge assembly of claim 15 wherein the uniquely patterned, leg sharing, U-shaped support ribs further comprise concentrically-nested, U-shaped support ribs, the concentrically-nested, U-shaped support ribs being positioned intermediate a posterior W-shaped support rib adjacent the posterior contact edge and an anterior W-shaped support rib adjacent the anterior contact edge, the concentrically-nested, U-shaped support ribs further comprising an outermost support rib, an intermediate support rib, and an innermost support rib.

17. The combination lid and hinge assembly of claim 16 wherein the crumple regions each further comprise two laterally-spaced, longitudinal support ribs and the support regions each further comprise seven U-shaped support ribs.

18. The combination lid and hinge assembly of claim 17 wherein the angled members are each further defined by comprising a pair of posterior hinge rod receiving knuckles, a pair of central hinge rod receiving knuckles, and a pair of anterior hinge rod receiving knuckles.

19. The combination lid and hinge assembly of claim 18 wherein the pivot portion termini of the posterior and anterior W-shaped support ribs are each further defined by comprising two compression-type knuckles and one tension-type knuckle, the tension-type knuckles comprising the pivot portion termini of the outermost support rib, the pivot portion termini of the intermediate support rib are each further defined by comprising tension-type knuckles, the pivot portion termini of the innermost support rib are each further defined by comprising compression-type knuckles, the compression-type knuckles being nestedly associated with the hinge rod receiving knuckles, the compression-type knuckles allowing the lateral pivot portions to withstand compressive forces should the lid members be pivoted more than about 75 degrees from a closed position, the tension-type knuckles being cooperatively associated with the hinge rods, the tension-type knuckles allowing the lateral pivot portions to withstand tensile forces should the lid members be pivoted more than 75 degrees from a closed position, the compression-type knuckles and the tension-type knuckles thus cooperatively acting to aid in the prevention of lateral pivot portion failure.

20. The combination lid and hinge assembly of claim 11 wherein the lid members each have means for manually opening the lid members while the refuse container is in a refuse containing position.

21. A combination lid and hinge assembly for use in conjunction with a refuse container, the refuse container having a perimeter support surface, the perimeter support surface defining a primary opening, the perimeter support surface being contiguous with an interior container surface, the combination lid and hinge assembly comprising:

two angled members attached to the perimeter support surface laterally opposite relative to one another, the angled members each comprising a substantially horizontal attachment portion, a substantially vertical stop portion, and a plurality of integrally-mounted, longitudinally-aligned hinge rod receiving knuckles, the hinge rod receiving knuckles each further comprising an exterior nesting surface and an interior hinge rod receiving surface;

two lid members, the lid members each comprising a medial closure edge, a lateral pivot portion, an anterior contact edge, a posterior contact edge, a crumple region adjacent the medial closure edge extending laterally, and a support region adjacent the lateral pivot portion extending medially, the crumple regions each further comprising a plurality of raised, longitudinal support ribs, the support regions each further comprising a plurality of raised, U-shaped, support ribs, the longitudinal support ribs and U-shaped support ribs effecting a patterned series of superior surfaces and a patterned series of inferior surfaces, each U-shaped support rib having a longitudinally-aligned base portion and two laterally-aligned leg portions, the leg portions each extending laterally to the lateral pivot portions terminating in a pivot portion terminus, a plurality of the pivot point termini having longitudinally-aligned hinge rod receiving apertures intermediate the superior and inferior surfaces, the lateral pivot portions each further comprising a longitudinal stop lip; and two hinge rods for hingedly connecting the lid members to the angled members, a plurality of the pivot point termini being formed to nestedly receive the exterior nesting surfaces, the hinge rod receiving surfaces and hinge rod receiving apertures being longitudinally aligned to receive the hinge rods, the hinge rods being inserted through the receiving surfaces and hinge rod receiving apertures thus hingedly connecting the lid members to the angled members, the stop lips being formed such that the lid members are allowed a pivotal range of motion about the axes of rotation, the pivotal ranges of motion being limited between a closed position wherein the anterior and posterior contact edges seat on the perimeter support surface to an open position wherein the stop lips contact the angled members, thus restricting the lid members from pivoting more than 90 degrees from the closed position.

22. The combination lid and hinge assembly of claim 21 wherein the hinge rod receiving knuckles are integrally mounted such that each lid member is allowed a pivotal range of motion about the axis of rotation, the pivotal ranges of motion being limited between a closed position wherein the anterior and posterior contact edges seat on the perimeter support surface to an open position wherein the stop lips contact the angled members thus restricting the lid members from pivoting more than about 75 degrees from the closed position.

23. The combination lid and hinge assembly of claim 21 wherein the support regions each further comprise uniquely patterned, leg sharing, U-shaped support ribs.

24. The combination lid and hinge assembly of claim 23 wherein the uniquely patterned, leg sharing, U-shaped support ribs further comprise concentrically-nested, U-shaped support ribs, the concentrically-nested, U-shaped support ribs being positioned intermediate a posterior W-shaped support rib adjacent the posterior contact edge and an anterior W-shaped support rib adjacent the anterior contact edge, the concentrically-nested, U-shaped support ribs further comprising an outermost support rib, an intermediate support rib, and an innermost support rib.

25. The combination lid and hinge assembly of claim 24 wherein the crumple regions each further comprise two laterally-spaced, longitudinal support ribs and the support regions each further comprise seven U-shaped support ribs.

26. The combination lid and hinge assembly of claim 25 wherein the pivot portion termini of the U-shaped support ribs are further defined by comprising a plurality of compression-type knuckles and a plurality of tension-type knuckles, the compression-type knuckles being nestedly associated with the hinge rod receiving knuckles, the compression-type knuckles allowing the lateral pivot portions to withstand compressive forces should the lid members be pivoted more than about 75 degrees from a closed position, the tension-type knuckles being cooperatively associated with the hinge rods, the tension-type knuckles allowing the lateral pivot portions to withstand tensile forces should the lid members be pivoted more than about 75 degrees from a closed position, the compression-type knuckles and the tension-type knuckles thus cooperatively acting to aid in the prevention of lateral pivot portion failure.

27. The combination lid and hinge assembly of claim 21 wherein the lid members and hinge rods are further defined by comprising cooperative means for retaining the hinge rods in operational position.

28. A combination lid and hinge assembly for use in conjunction with a refuse container, the refuse container having a perimeter support surface, the perimeter support surface defining a primary opening, the perimeter support surface being contiguous with an interior container surface, the combination lid and hinge assembly comprising:

two lid members, the lid members each comprising a substantially planar structure, the planar structure further comprising a medial closure edge, a lateral pivot portion, an anterior contact edge, a posterior contact edge, a crumple region adjacent the medial closure edge extending laterally, and a support region adjacent the lateral pivot portion extending medially, the crumple regions allowing the lid members to reversibly flex should the planar structure be exposed to planar compressive forces, the crumple regions each further comprising a plurality of raised, longitudinal support ribs, the support regions each further comprising a plurality of raised, U-shaped, support ribs, the longitudinal support ribs and the U-shaped support ribs allowing the lid members to withstand nonplanar compressive forces, the longitudinal support ribs and U-shaped support ribs effecting a patterned series of sloped superior surfaces, the superior surfaces providing means for allowing surface-located matter to transition from a point of superior potential energy to a point of inferior potential energy, the superior surfaces transitioning to a patterned series of sloped inferior surfaces, the inferior surfaces providing further means for allowing surface-located matter to transition from a point of superior potential energy to a point of inferior potential energy, each U-shaped support rib having a longitudinally-aligned base portion and two laterally-aligned leg portions, the leg portions each extending laterally to the lateral pivot portions terminating in a pivot portion terminus, a plurality of the pivot point termini having longitudinally-aligned hinge rod receiving apertures intermediate the superior and inferior surfaces, the lateral pivot portions each further comprising a longitudinal stop lip; and means for hingedly attaching each lateral pivot portion to the perimeter support surface, each lateral pivot portion being hingedly attached to the perimeter support surface.

29. The combination lid and hinge assembly of claim 28 wherein the means for hingedly attaching the lateral pivot portions to the perimeter support surface is further defined by comprising:

two longitudinally-aligned angled members attached to the perimeter support surface laterally opposite in parallel relation to one another, the angled members each comprising a substantially horizontal attachment portion, a substantially vertical stop portion, and a plurality of integrally-mounted, longitudinally-spaced, longitudinally-aligned hinge rod receiving knuckles, the vertical stop portions being substantially flush with the interior container surface, the hinge rod receiving knuckles each further comprising an exterior nesting surface and an interior hinge rod receiving surface; and two hinge rods for hingedly connecting the lid members to the angled members, a plurality of the pivot portion termini being formed to nestedly receive the exterior nesting surfaces, the hinge rod receiving surfaces and hinge rod receiving apertures being longitudinally aligned to receive the hinge rods, the hinge rods being inserted through the hinge rod receiving surfaces and hinge rod receiving apertures thus hingedly connecting the lid members to the angled members, the stop lips being formed such that the lid members are allowed a pivotal range of motion about the axes of rotation, the pivotal ranges of motion being limited between a closed position wherein the anterior and posterior contact edges seat on the perimeter support surface to an open position wherein the stop lips contact the angled members thus restricting the lid members from pivoting more than 90 degrees from the closed position.

30. The combination lid and hinge assembly of claim 29 wherein the pivot portion termini of the U-shaped support ribs are further defined by comprising a plurality of compression-type knuckles and a plurality of tension-type knuckles, the compression-type knuckles being nestedly associated with the hinge rod receiving knuckles, the compression-type knuckles allowing the lateral pivot portions to withstand compressive forces should the lid members be pivoted more than about 75 degrees from a closed position, the tension-type knuckles being cooperatively associated with the hinge rods, the tension-type knuckles allowing the lateral pivot portions to withstand tensile forces should the lid members be pivoted more than about 75 degrees from a closed position, the compression-type knuckles and the tension-type knuckles thus cooperatively acting to aid in the prevention of lateral pivot portion failure.

31. The combination lid and hinge assembly of claim 30 wherein the support regions each further comprise uniquely patterned, leg sharing, U-shaped support ribs.

32. The combination lid and hinge assembly of claim 31 wherein the uniquely patterned, leg sharing, U-shaped support ribs further comprise concentrically-nested, U-shaped support ribs, the concentrically-nested, U-shaped support ribs being positioned intermediate a posterior W-shaped support rib adjacent the posterior contact edge and an anterior W-shaped support rib adjacent the anterior contact edge, the concentrically-nested, U-shaped support ribs further comprising an outermost support rib, an intermediate support rib, and an innermost support rib.

33. The combination lid and hinge assembly of claim 32 wherein the crumple regions each further comprise two laterally-spaced, longitudinal support ribs and the support regions each further comprise seven U-shaped support ribs.

34. A refuse container lid assembly for use in conjunction with a refuse container, the refuse container having a perimeter support surface, the perimeter support surface defining a primary opening, the refuse container lid assembly comprising:

at least two lid members, the lid members each comprising a medial closure edge, a lateral pivot portion, an anterior contact edge, a posterior contact edge, a crumple region adjacent the medial closure edge extending laterally, and a support region adjacent the lateral pivot portion extending medially, the crumple regions each further comprising a plurality of raised, longitudinal support ribs, the support regions each further comprising a plurality of raised, U-shaped support ribs, the longitudinal support ribs and U-shaped support ribs effecting a patterned series of superior surfaces and a patterned series of inferior surfaces, each U-shaped support rib having a longitudinally-aligned base portion and two laterally-aligned leg portions, the leg portions each extending laterally to the lateral pivot portions terminating in a pivot portion terminus, a plurality of the pivot point termini having means for hinged attachment to the refuse container, the lateral pivot portions each further comprising a stop structure; and means for hingedly attaching each lid member to the refuse container, each lid member being hingedly attached to the refuse container, the stop structures being formed such that the lid members are allowed a pivotal range of motion about the point of hinged attachment, the pivotal ranges of motion being limited between a closed position wherein the anterior and posterior contact edges seat on the perimeter support surface to an open position wherein the stop structures contact the means for hingedly attaching each lid member to the refuse container, thus restricting the lid members from pivoting more than 75 degrees from the closed position.

35. The combination lid and hinge assembly of claim 34 wherein the support regions each further comprise uniquely patterned, leg sharing, U-shaped support ribs.

36. The combination lid and hinge assembly of claim 35 wherein the uniquely patterned, leg sharing, U-shaped support ribs further comprise concentrically-nested, U-shaped support ribs, the concentrically-nested, U-shaped support ribs being positioned intermediate a posterior W-shaped support rib adjacent the posterior contact edge and an anterior W-shaped support rib adjacent the anterior contact edge, the concentrically-nested, U-shaped support ribs further comprising an outermost support rib, an intermediate support rib, and an innermost support rib.

37. The combination lid and hinge assembly of claim 36 wherein the crumple regions each further comprise two laterally-spaced, longitudinal support ribs and the support regions each further comprise seven U-shaped support ribs.

* * * * *